United States Patent [19]

Balzano et al.

[11] 3,951,497

[45] Apr. 20, 1976

[54] ELECTRICAL BUSS CONNECTOR

[75] Inventors: Alfiero F. Balzano, Fullerton; David W. Ohlrich, Redondo Beach, both of Calif.

[73] Assignee: Logic Dynamics, Inc., Gardena, Calif.

[22] Filed: Jan. 16, 1975

[21] Appl. No.: 541,499

[52] U.S. Cl. ..... 339/19; 339/95 R; 339/242; 339/278 C

[51] Int. Cl.[2] ..... H01R 31/08

[58] Field of Search ..... 339/18, 19, 22, 95, 339/242, 258 P, 256 C, 278 C

[56] References Cited

UNITED STATES PATENTS

| | | | |
|---|---|---|---|
| 1,615,168 | 1/1927 | Doppke | 339/258 P |
| 3,175,179 | 3/1965 | Trump | 339/18 C |
| 3,582,864 | 6/1971 | Sullivan | 339/19 |
| 3,609,634 | 9/1971 | Hovnanian et al. | 339/19 |
| 3,668,606 | 6/1972 | Walter | 339/19 |
| 3,686,750 | 8/1972 | Woolcock et al. | 174/126 CP |

*Primary Examiner*—Roy Lake
*Assistant Examiner*—Neil Abrams
*Attorney, Agent, or Firm*—Roger A. Marrs

[57] ABSTRACT

An electrical buss connector is disclosed herein for interconnecting a plurality of separate and spaced-apart electrical pin contacts that are arranged in a row. The connector includes a single electrically conductive strip having a plurality of integral spring-biased elements carried by the strip. Apertures are formed in the junction area where each spring-biased element joins with the strip for inserably receiving the pin contact. Each element includes an elongated leaf portion having an indentation adapted to receive a portion of the pin thickness against which the leaf or spring-biased element bears. Each element is adapted for separation from the strip through structural fatigue and a non-electrically conducting material is installed upon the strip in the areas thereof from which the elements have been separated.

7 Claims, 5 Drawing Figures

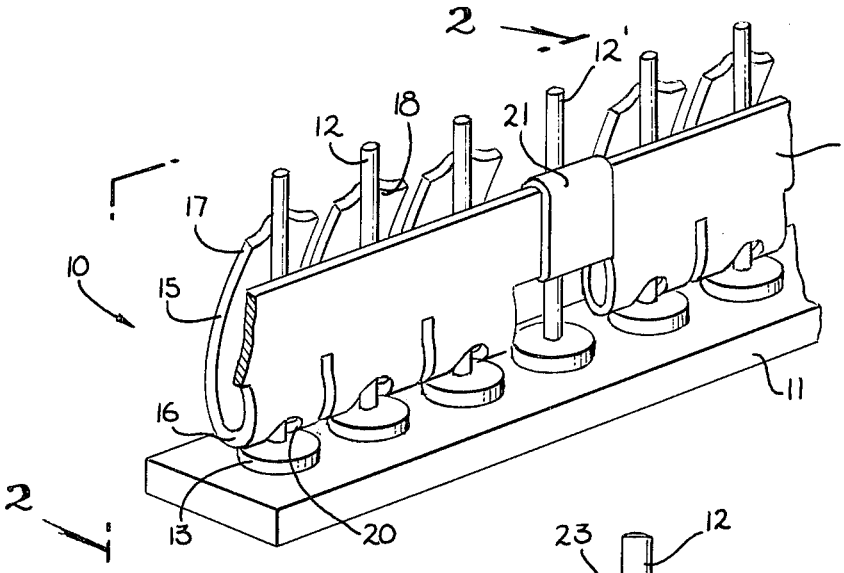
Fig. 1
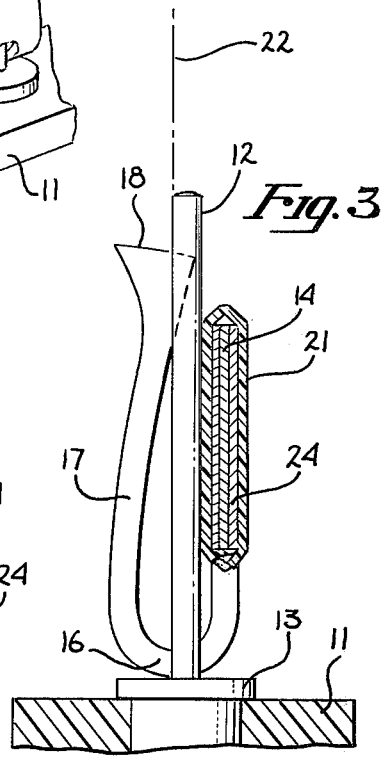
Fig. 3
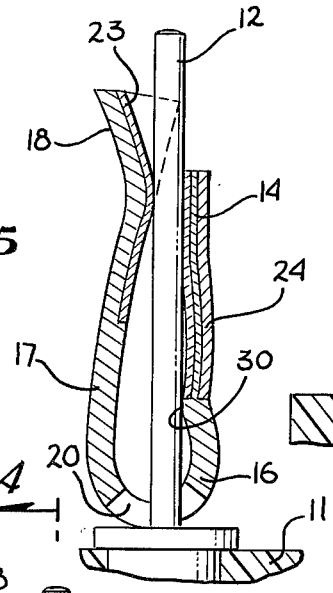
Fig. 5
Fig. 2
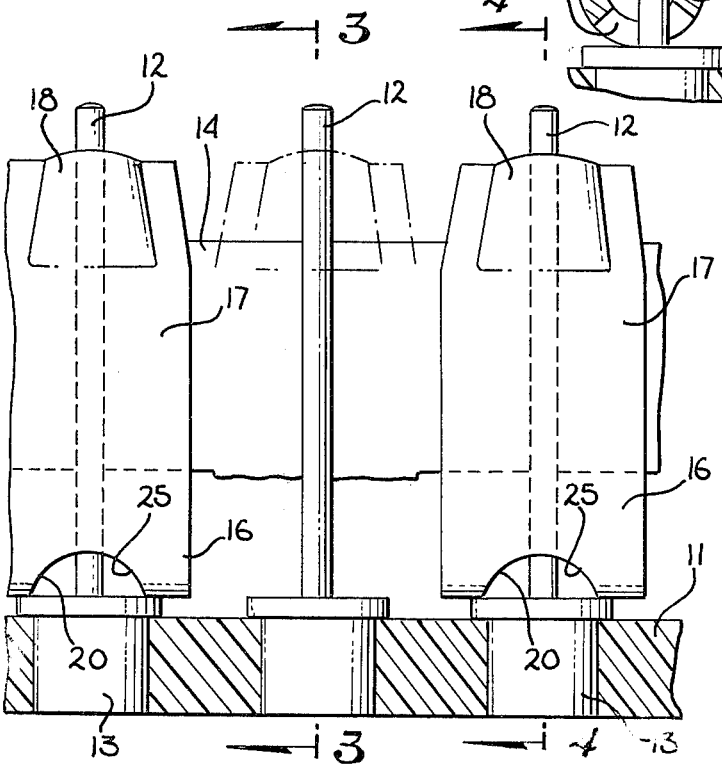
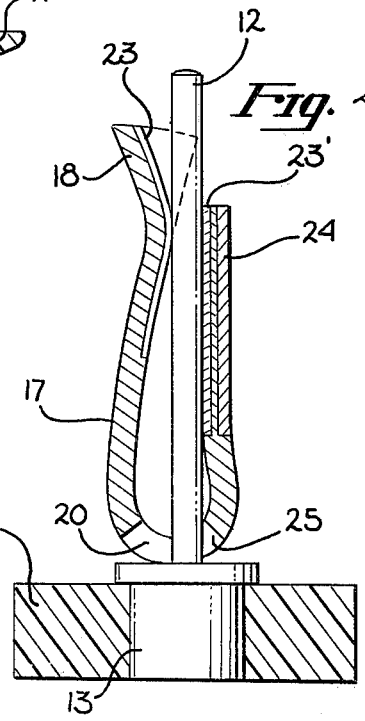
Fig. 4

ELECTRICAL BUSS CONNECTOR

BACKGROUND OF THE INVENTION

1. Field of the Invention

This invention relates to the field of electrical hardware and more particularly to an electrical buss strip which interconnects a plurality of spaced-apart pin contacts or terminals in the assembly and construction of electrical circuit boards.

2. Brief Description of the Prior Art

In the manufacturing and assembling of electronic circuit boards, it has been the conventional practice to employ a block or foundation of electrically insulating material for supporting a plurality of electrically conducting terminals arranged in fixed spaced-apart relationship and wherein the electronic components and circuitry or assemblies are mounted therebetween or thereon. A conventional form of terminal comprises an elongated member generally stamped from sheet material and consisting of an elongated pin portion provided at one end with a U-shaped lug or other lug configuration at the other end. The circuit board generally provides for the pin side of the terminals to project from one side of the circuit board so that various wiring and external circuit conductors may be wire wrapped to the pin side of the terminal.

In some electrical circuits, it is required that many terminals be connected to one another by a common strip or line for purposes of grounding, thermal conductivity, common power supply, etc. Such strips are known as buss strips or bars. One conventional buss strip currently in use is simply an uninsulated wire which has been cut to desired length and held against the terminals temporarily until permanent solder connections to the terminals can be made. Using a wire for buss strip purposes is time consuming in production assembling operations since some means are required for temporarily retaining the wire in place. Also, the wires often fall from their positions on the circuit board and must be reinstalled.

Another conventional buss strip, such as disclosed in U.S. Pat. No. 3,582,864, overcomes the inherent temporarily retaining problem by employing a plurality of folded-over metal leaf clamps which are connected together by a common strip. It is attached to the circuit board by clamping each leaf of the plurality to a separate pin on the wiring side of the circuit board. Each metal clamp is provided with a small aperture to receive the pin portion of the terminal and the folded metal portion of the clamp is sufficiently resilient to grip the pin portion of the terminal as the strip is installed.

However, difficulties and problems have been encountered when employing such conventional buss line or strip devices which are due to the fact that inadequate electrical and mechanical contact is made between the leaf portion of the clamp and the terminal. For example, the leaf portion is flat and rests against the flat side of the pin. However, when round terminals are employed, the flat side of the leaf nearly touches the rounded terminal at a single point. Such a single point contact creates a hot spot when high currents are employed and, the remaining surface area of the leaf is of no value as a contact at all. Furthermore, the aperture provided in the leaf-clamp device for receiving the pin is not employed in retaining the clamp onto the pin. The aperture is merely a hole which permits the clamping device to be placed onto the pins but in no way serves to effect a mechanical friction or grip separately or in combination with the leaf spring portion of the device.

Therefore, a long standing need has been established to provide a buss line or connector that will readily grip and clasp with each of the respective pins so that adequate mechanical and electrical connection is made.

SUMMARY OF THE INVENTION

The problems and difficulties described with respect to conventional buss strips are obviated by the present invention which provides a novel resilient buss connector comprising an elongated strip of electrical material having a plurality of folded-over leaf clamp which downwardly depend from the common strip and includes a U-shaped portion having an aperture formed therein for insertably receiving the pin of a pin connector and an upwardly projecting leaf or element that is normally spring-biased into contact with the opposite side of the pin from that engaging the strip. The leaf element or member includes a shaped indentation at its extreme end so that the end of the leaf element forms a semi-circular configuration so as to engage with a rounded pin providing maximum surface contact with the respective element and pin. Each of the leaf spring clamp or element are adapted to be separated from the strip by breaking the leaf element from the strip and a non-electrically conducting element is placed upon the strip in the area provided by the separated leaf which serves as an insulation between the strip and the adjacent pin. Furthermore, the present invention used improved contact materials so that the device is suitable for its intended purpose.

Therefore, it is among the primary objects of the present invention to provide a novel buss line or strip device which provides increased current capability as well as thermal conductivity and reliability due to improved surface contacts between the device and its associated pin.

Another object of the present invention is to provide a novel buss line or strip device having a self-biased leaf spring element capable of pressing against a pin on which it is mounted and further having a formed indentation corresponding to the external shape of the pin for increased contact surface area and improved reliability.

The features of the present invention which are believed to be novel are set forth with particularity in the appended claims. The present invention, both as to its organization and manner of operation, together with further objects and advantages thereof, may best be understood by reference to the following description taken in connection with the accompanying drawings.

BRIEF DESCRIPTION OF THE DRAWINGS

FIG. 1 is a perspective view illustrating the novel buss strip of the present invention mounted in a typical application with respect to a plurality of pins carried on a terminal block;

FIG. 2 is an enlarged longitudinal cross sectional view of the buss strip device shown in FIG. 1 as taken in the direction of arrows 2—2 thereof;

FIG. 3 is a transverse cross sectional view of the buss strip device of the present invention taken in the direction of arrows 3—3 of FIG. 2;

FIG. 4 is a transverse cross sectional view of the novel buss strip device as taken in the direction of arrows 4—4 of FIG. 2; and FIG. 5 is a side view similar to the view of FIG. 4 illustrating a modification thereto in the form of a fulcrum point.

DESCRIPTION OF THE PREFERRED EMBODIMENT

Referring to FIG. 1 of the drawing, the novel electrical buss connector of the present invention is illustrated in the general direction of arrow 10 and is illustrated in a typical application for mechanically and electrically joining a plurality of spaced-apart pins in electrical contact. The invention 10 is employed with a terminal board 11. Projecting upwardly from the surface of the terminal board 11, a plurality of terminal pins 12 are provided. As shown in the drawing, the terminal pins 12 are aligned in a single row and the pins are in fixed spaced-apart relationship with respect to each other. However, it is to be understood that each terminal board would have a plurality of rows of terminal pins similar to the row illustrated. Although it is to be understood that many geometric configurations for pin or post cross section may be involved, a circular or rod-like pin or post is illustrated. Other posts such as posts having sharp corners may be employed and the present invention will work therewith.

Each of the respective pins 12 include a circular base 13 which is directly in contact with the insulated material of the board 11 and each of the respective pins 12 may provide a female connector or terminating end on the opposite side of the board 11 from the side projecting pin 12. However, the pin itself forms no part of the present invention other than to provide a polygonal or geometric shape to which the buss strip of the present invention corresponds or matingly engages therewith.

The novel buss strip of the present invention includes an elongated strip 14 which is composed of electrical conducting material so that current will pass therethrough. Extending from a single edge of the strip 14, there are provided a plurality of self-biased leaf elements 15. Each leaf element 15 includes an arcuate portion 16 that is integrally formed with the strip 14 and an end portion 17 which is formed with a critically and specially formed indentation 18. Formed in the arcuate portion 16, there is provided a sharp edge aperture or opening 20 adapted to insertably receive the pin 12. The terminal pin or post 12 is inserted through the aperture 20 and forced upwardly between the opposing surfaces of strip 14 and the end portion 17 of the leaf element 15 so that the exterior surface of pin 12 is in a contactural relationship with both the strip 14 and the end portion 17. Each of the leaf elements 15 are internally biased so as to maintain the contactural relationship with their respective posts or pins 12. The spacing between adjacent pins 12 are to be identical to the spacing of the apertures 20 in adjacent arcuate portions 16.

It is to be particularly pointed out that the indentation 18 is semi-circular so as to mate with the circular exterior surface of the pin 12. In this manner, the indentation 18 provides a short channel into which a portion of the pin 12 length resides so as to provide an enlarged contact area between the leaf element 15 and the pin 12.

Each of the leaf elements 15 are capable of being "broken away" from the strip 14 at the juncture of the arcuate portion 16 with the strip. The separation is accomplished by manually working each of the leaf arms or elements 15 to a position adjacent the opposite side of strip 14 so that material failure of the construction occurs. When separation has taken place, a non-electrically conducting material 21 is installed about the strip 14 in the area of the removed leaf element. Preferrably, the insulating material 21 may be a polychloride plastic material which when heated or provided with a suitable solvent, will shrink or reduce so as to grip and hold tightly to the remaining portion of strip 14. When the material is so placed thereon, the strip is completely insulated or isolated from the pin 12 and no electrical current can flow therebetween. Furthermore, since no part of the strip is exposed in close proximity to the pin, there can be no danger of jumping sparks or Eddy current loss therebetween.

As shown in FIG. 2, the indentation 18 provides a substantial area of spring leaf element 15 contact with the post or pin 12. The indentation or channel-like construction of end portion 17 will accommodate posts of other geometric configurations than circular in cross section.

In FIG. 3, the elongated contact surface area between the leaf element end portion 17 and the external surface of pin 12 is again illustrated. Furthermore, it can be seen how the insulated element 21 separates the strip 14 from the pin 12. It should also be noted that an asymmetrical relationship is established with respect to the opening 20 through which the pin passes and with particular emphasis pertaining to the central longitudinal center line of the device. This center line is illustrated by numeral 22 and it can be seen that the center line of the buss strip device is not co-extensive with the central axis or center line of the row of pins. By this design, a greater spring force is established to retain the strip 14 on the row of pins than can otherwise be gained.

Referring now in detail to FIG. 4, it can be seen that the contact areas and points between the buss strip device of the present invention and the post or pin 12 are specially constructed. For example, the leaf element 15 includes a cut-out portion which is filled with a gold material as indicated by numeral 23. Gold is also annealed or otherwise deposited into a recess on strip 14 and is represented by numeral 23'. For improved current carrying capabilities, the buss strip device includes a thin layer of copper, indicated by numeral 24, which runs the full length on the exterior outer surface of the strip 14. Therefore, it can be seen that the contact with pin 12 includes the best of the electrical conducting materials and the hardest of materials so that wear will not occur. Furthermore, the off-center relationship as described with respect to FIG. 3 insures that the sharp corner indicated by numeral 25 will embed itself within the material of the pin or post 12 so that electrical and mechanical contact is assured.

For installation of the buss strip device 10 about a row of pins 12, it is necessary to establish which post 12 are to be connected electrically and which are to be insulated from the strip and each other. The leaf element 15 which corresponds to the pin 12 to which it is not desired to connect electrically, are removed from the strip 14. A segment of pre-shrunk tubing 21 is placed about the strip 14 and heat energy applied thereto to cause the tubing to shrink about the strip portion in a tight fitting manner. As mentioned earlier, solvent may be employed with certain plastics to effect shrinkage as well. The device 10 is then placed over a series of posts or pins 12 with the pins 12 which are to be electrically placed in common being inserted through the respective apertures 20 of leaf element 15. Thereby the pins 12 which cooperate with leaf element 15 are electrically common with one another. The other pins or posts in the row are prevented from joining in common electrically connection by reason of the tubing located between each strip and the post.

Therefore, in view of the foregoing it can be seen that the novel buss connector of the present invention provides an improved buss strip or bar which overcomes many problems encountered with the prior art. The buss strip as disclosed in U.S. Pat. No. 3,582,864 does not provide means for engaging the pin at the area of the opening or aperture and improved or adequate electrical current conduction is not available. Also, the tubing installation around the strip from which a leaf arm has been disconnected leaves a small area at the top of the insulation as shown in FIG. 3 of the aforementioned patent through which any current loss and spark jumping may occur. Also, the spring leaf as indicated by numeral 24 and the figures of the aforementioned patent do not provide a shape which conforms to the pin configuration. These problems are overcome in the present invention whereby copper strip 24 is employed for conducting current along the strip and the copper strip 24 is inlaid into a recess formed in the strip 14. Also, the gold inlay 23 and 23' are also placed into recesses within the strip 24 and the leaf 17 so as to provide proper current conduction. Also, the present invention provides for proper mechanical and electrical connections by the asymmetrical relationship of the aperture with respect to the center line of the row of pins so that the corner 25 cuts into the pin 12. The gold insert or layer 23 and 23' provides low contact resistance while the copper layer or insert provides high electrical conductivity. The strip material may be of lower electrical conductivity such as phosphorous bronze; however, this material provides the necessary rigidity for the device.

In order to increase the spring bias of the leaf element so as to more forceably press against the post, a fulcrum point 30, as seen in FIG. 5, may be formed on the arcuate portion 16 whereby the self bias of the element is in the direction of the opposing surface of strip 14. The fulcrum point 30 presses or embeds against the opposite side of post 12 from the side pressed against by leaf element 17. Also, it is envisioned by the present invention that the elimination of leaf elements need not be manually broken away. During the construction of the strip, elimination can be programmed into the tooling so that leaf elements simply do not appear at selected, critical locations along the length of the strip. Therefore, straight lower and upper edges are produced without the rough and irregular lower edge normally encountered when structural "breaking away" occurs.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In combination with an electrical terminal board having a plurality of terminal posts extending therefrom in a row in fixed spaced apart relationship and said posts being electrically insulated with respect to each other, an electrical buss conductor comprising the improvement of:

an elongated electrically conducting strip;

a plurality of leaf elements connected to said strip along a lower edge thereof in downwardly depending relationship and having an arcuate portion interconnecting body portion to said lower edge of said strip;

each of said arcuate portions having an opening defined by a sharp edged corner being capable of permitting insertion of one of said posts therethrough and locating said post between said strip and said body portion in electrically conducting relationship;

each of said body portions having a shaped indentation at their terminating ends for receiving and semi-wrapping about its associated post and wherein the central longitudinal axis of said row of said posts is off-set from the central axis of said arcuate opening whereby a portion of said sharp corner cuts into said post to provide for both electrical and mechanical connection therebetween;

said strip includes a recess provided along its length; and a copper material of higher electrical conductivity than the material of said strip carried in said recess.

2. The invention as defined in claim 1 wherein each of said leaf elements being detachable from said strip by causing a material structural failure therebetween;

a non-electrical conducting material being applied to said strip in the area of the removed leaf element; and said non-electrical conducting material completely surrounding said area of removed leaf element so that upper and lower edges thereof are covered by said material.

3. The invention as defined in claim 2 wherein said shaped indentation corresponds to the exterior shape of said post.

4. The invention as defined in claim 3 wherein said leaf element is self-biased via said arcuate portion to press and clamp said indentation against said post.

5. The invention as defined in claim 4 wherein a second and a third recess is provided in the opposing surfaces of said indentation portion and said strip; and a layer of gold material is carried in each of said second and third recesses respectfully.

6. The invention as defined in claim 5 wherein said gold material provides low contact resistance;

said copper material provides high electrical conductivity; and said strip is phosphorous bronze which provides structural rigidity.

7. The invention as defined in claim 5 wherein selected and critical areas along said strip are characterized by the absence of said leaf elements; and said selected and critical areas of said strip carry insulation material so as to electrically insulate said strip from associated and pre-programmed ones of said posts.

* * * * *